United States Patent [19]

Ottoson

[11] Patent Number: 4,495,710

[45] Date of Patent: Jan. 29, 1985

[54] METHOD FOR STABILIZING PARTICULATE LOW RANK COAL IN A FLUIDIZED BED

[75] Inventor: Javan D. Ottoson, Anchorage, Ak.

[73] Assignee: Atlantic Richfield Company, Los Angles, Calif.

[21] Appl. No.: 519,177

[22] Filed: Aug. 1, 1983

[51] Int. Cl.[3] ..... F26B 3/08; C10L 5/00; F27B 15/00

[52] U.S. Cl. ..... 34/10; 44/10 J; 432/15

[58] Field of Search ..... 34/10, 57 A; 432/15; 44/1 G, 10 E, 10 J

[56] References Cited

U.S. PATENT DOCUMENTS

| | | | |
|---|---|---|---|
| 3,745,668 | 7/1973 | Vian-Ortuno et al. | 34/57 A |
| 4,324,544 | 4/1982 | Blake | 34/10 |
| 4,396,394 | 8/1983 | Li et al. | 34/13 |

*Primary Examiner*—John J. Camby
*Attorney, Agent, or Firm*—F. Lindsey Scott

[57] ABSTRACT

An improved method for drying particulate low rank coal in a fluidized bed wherein the improvement comprises fluidizing the coal above a first portion of a gas flow distributor using a hot fluidizing gas and fluidizing the coal above a second portion of the gas flow distributor with a recycle gas stream at a temperature less than about 200° F. wherein the second portion of the gas flow distributor is located near the coal discharge from the coal drying zone to cool overheated coal particles.

10 Claims, 2 Drawing Figures

METHOD FOR STABILIZING PARTICULATE LOW RANK COAL IN A FLUIDIZED BED

Figures 1, 2:
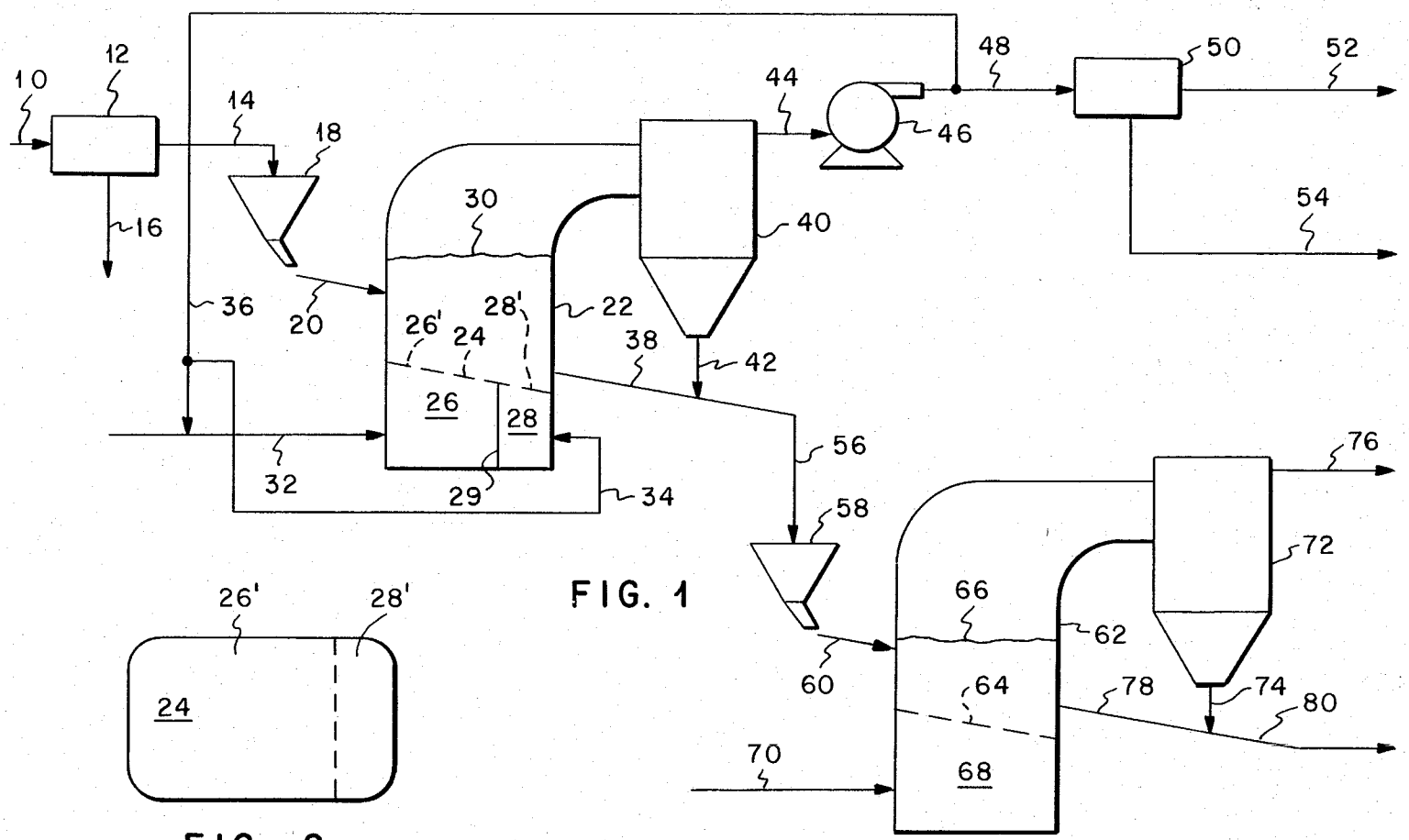

This invention relates to an improved method for drying particulate low rank coal in a fluidized bed.

In many instances, coal, as mined, contains undesirably high quantities of water for transportation and use as a fuel. This problem is common to all coals although in higher rank coals, such as anthracite and bituminous coals, the problem is less severe because the water content of the coal is normally lower and the heating value of such coals is higher. The situation is different with respect to lower rank coals, such as sub-bituminous, lignite and brown coals. Such coals, as produced, typically contain from about 20 to about 65 weight percent water. While many such coals are desirable as fuels because of their relatively low mining cost and since many such coals have a relatively low sulphur content, the use of such lower rank coals as fuel has been greatly inhibited by the fact that as produced, they typically contain a relatively high percentage of water. Attempts to dry such coals for use as a fuel have been inhibited by the tendency of such coals after drying to undergo spontaneous ignition and combustion in storage, transit or the like and by the tendency of such coals during drying to ignite, particularly in the coal drying zone or immediately after discharge from the coal drying zone.

The drying required by such low rank coals is deep drying for the removal of surface water plus the large quantities of interstitial water present in such low rank coals. By contrast, when higher grade coals are dried, the drying is commonly for the purpose of drying the surface water from the coal particle surfaces but not interstitial water since the interstitial water content of the higher rank coals is relatively low. As a result, short residence times in the drying zone are normally used and the interior portions of the coal particles are not heated since such is not necessary for surface drying. Normally, the coal leaving the dryer in such surface water drying processes is at a temperature below about 150° F. (about 65° C.) and more typically below about 110° F. (about 45° C.). By contrast, processes for the removal of interstitial water require longer residence times and result in heating the interior portions of the coal particle. The coal leaving a drying process for the removal of interstitial water will typically be at a temperature from about 130° to about 250° F. (about 54° to about 120° C.). When such processes for the removal of interstitial water are applied to low rank coals, the coal has a tendency to ignite in the fluidized bed as a result of the contact between the high temperature gases normally used as a hot fluidizing gas to dry the coal and coal particles which have been dried to a relatively low water content. As a result, problems are encountered in coal drying zones as a result of the ignition of the particles in the drying zone and as a result of combustion of the coal particles after they leave the drying zone and contact air. In some instances, the problems are attributed at least in part to the presence of randomly distributed overheated particles which may, in fact, be glowing embers in the bed of coal in the fluidized bed or the discharge stream. Clearly, the presence of such overheated particles in a mass of highly active dried, low rank coal is undesirable and creates almost certain combustion problems.

According to the present invention, such problems are mitigated in methods for drying particulate low rank coal in fluidized beds by:

(a) charging the coal to a coal drying zone;

(b) supporting the coal above a support means in the coal drying zone, the support means being adapted to the flow of a hot fluidizing gas upwardly through the support means and the coal;

(c) flowing hot fluidizing gas through the support means and the coal to fluidize the coal and dry said coal; and, (d) retaining the coal in the drying zone for a time sufficient to reduce the water content of the coal to desired level;

by an improvement comprising: fluidizing the coal above a first portion of the support means with a hot fluidizing gas to dry the coal and fluidizing the coal above a second portion of the support means adjacent the coal discharge from the coal drying zone with a recycle gas stream to cool overheated coal particles.

FIG. 1 is a schematic diagram of a coal drying process embodying the improvement of the present invention; and, FIG. 2 is a top view of a support means or grate demonstrating the improvement of the present invention.

In the discussion of the FIGURES, the same numbers will be used to refer to the same or similar components throughout.

In the discussion of the invention, reference will be made to "lines" to refer to conveyors, conduits and the like as commonly used to transport solid, liquid or gaseous materials as the case may be.

In FIG. 1, a coal drying process is shown. Coal is charged to a coal treatment zone 12 via a line 10. In coal treatment zone 12, the coal may be crushed to a desired size and inorganic materials, such as clays and gangues, may be separated from the coal and discarded through a line 16. It should be understood that in many instances coal treatment to remove inorganic materials is not required or used with low rank coals. The coal is passed from coal treatment zone 12 through a line 14 to a hopper 18 to provide a coal feed through a line 20 to a coal dryer 22. The coal charged to dryer 22 through line 14 may be of any size up to a size consist of about 2 inches by 0 although preferably the coal is of a size consist of about 1 inch by 0 and more desirably, ¾ inch by 0. Coal is charged from hopper 18 to dryer 22 via line 20 and a bed 30 of coal is maintained in dryer 22 above a support means shown as distributor 24. Distributor 24 may comprise a bar grate, a perforated plate, bubble caps, valve trays or other means known to the art for use in maintaining coal bed 30 in a fluidized condition above distributor 24. By the improvement of the present invention, a hot fluidizing gas is charged to a distribution zone 26 beneath a first portion 26' of distributor 24 in dryer 22. The hot fluidizing gas flows upwardly through first portion 26' of distributor 24 at a rate suitable to fluidize the coal in bed 30. A portion of the smaller coal particles are typically entrained out of bed 30 and recovered in a gassolids separator such as cyclone 40. The hot fluidized gas may be produced by burning a suitable fuel, such as carbonaceous liquids, coal fines or the like to produce a combustion gas at a desired temperature. The composition of the fluidizing gas stream can be adjusted by various techniques such as the use of recycle or diluent streams, steam injection or the like. For instance, the composition of the fluidizing gas can be adjusted by the use of a recycle stream taken from the exhaust from dryer 22. Other streams could be used alone or in combination with such a recycle stream to adjust the composition of the fluidizing gas streams. Many such variations may be used to adjust the fluidizing gas composition to a desired range. Such a recycle stream is supplied in FIG. 1 via a line 36 from the exhaust from dryer 22. By the improvement of the present invention, a second portion 28' of distributor 24 is positioned over a second distribution chamber 28 to which a fluidizing gas is supplied via a line 34. Second distribution chamber 28 may be formed by placing a partition 29 beneath distributor 24 to divide the gas distribution zone beneath distributor 24 into distribution zones 26 and 28. The gas supplied via line 34 is at a temperature below about 200° F. (about 95° C.) and desirably is a recycle stream taken from the exhaust from dryer 22. This stream is particularly suitable since it is at substantially the same conditions that prevail above bed 30 in dryer 22. The gas is flowed upwardly through second portion 28' of distributor 24 at a rate sufficient to fluidize bed 30 above distributor 24. Desirably, the gas flow rates through first portion 26' of distributor 24 and second section 28' of distributor 24 are substantially the same, i.e. at substantially the same flow rate upwardly through bed 30. Clearly, distributor portions 26' and 28' are not the same in cross-sectional area, therefore, the net volume of gas flowing through portion 26' will not be the same as flows through section 28' but it is desirable that the linear velocity of the gas flow through each section be substantially the same.

The exhaust gas from dryer 22 flows to cyclone 40 where finely divided particulate solids are recovered through a line 42 for further processing, recombination with the dried coal recovered from dryer 22 through a line 38 or the like. The gaseous discharge from cyclone 40 is passed through a line 44, an exhaust fan 46 and a line 48 to a fine solids recovery section 50 where finely divided particulate solids in the nature of dust and the like are separated and recovered through a line 54. The finely divided solids may be passed to use as a fuel, further processing to produce larger particle of coal or the like. The cleaned gases are exhausted through a line 52 and may be passed to further clean-up and the like as required for discharge to the environment.

The dried coal streams recovered through line 38 and line 42 are passed through a line 56 to a hopper 58 for use as a feed stream via a line 60 to a cooler 62. In cooler 62, the coal is supported above a support member shown as a distributor 64 in a bed 66 with cooling gas being supplied through a line 70 via a distribution chamber 68 to fluidize and cool the coal in bed 66. Distributor 64 may comprise a bar grate, perforated plate, bubble caps, valve trays or other means known to the art for evenly distributing gas flow upwardly through distributor 64 and bed 66. The cooled coal from bed 66 is recovered through a line 78. The exhaust gases from cooler 62 are passed to a gas-solids separator such as a cyclone 72 from which a gaseous stream is recovered through a line 76 and passed to discharge, to further clean up prior to discharge or the like. An underflow stream is recovered from cyclone 72 through a line 74 and comprises finely divided particles which have been entrained in the exhaust stream from cooler 62. As shown in FIG. 1, the finely divided particles recovered through line 74 are blended with the particles recovered through line 78 to produce a product stream recovered through a line 80.

It will be understood that the finely divided solids recovered through lines 42, 74 and 54 can be treated in a variety of ways or used as fuel. For instance, the finely divided solids could be briquetted, pelletized or otherwise made into larger particles by a variety of means known to those skilled in the art and optionally combined with the larger coal particles. In such instances, the processed finely divided solids may not require cooling in cooler 62.

In the practice of processes such as that shown in FIG. 1, the hot gases used to fluidize and dry the coal in bed 30 are typically at temperatures from about 400° to about 900° F. (about 204° to about 538° C.) As is well known to those skilled in the art, when low rank coal particles are dried to low water contents, i.e. ten percent or less, they are readily ignited and in fact tend to undergo spontaneous combustion at such elevated temperatures. In the use of fluidized beds, inevitably some particles are more quickly dried than others and as a result, relatively dry coal particles are in many instances in direct contact with the hot gases used to fluidize and dry the coal. In many instances, such dried particles tend to ignite and continue to smolder until the particles are discharged from dryer 22 at which point they ignite upon coming into contact with air. Such is obviously an undesirable situation and is mitigated to a large degree by the improvement of the present invention. As shown in FIG. 1, a recycle gas is used as a part of the hot fluidizing gas used to fluidize bed 30 above first portion 26' of distributor 24. By the use of second portion 28' of distributor 24 as discussed above, the particles are fluidized for a significant period of time by a relatively cool gas which approximates the exhaust gas composition from dryer 22. This is accomplished by the use of a recycle stream of exhaust gas from dryer 22 which results in maintaining the temperature of the coal in bed 30 above second portion 28' at a temperature approximating the exhaust gas from dryer 22. This recycle gas is relatively high in humidity and relatively low in oxygen. As a result, it tends to extinguish glowing embers of coal and to cool particles which have been heated to a temperature above the average temperature of the coal in bed 30.

In FIG. 2, a top view of distributor 24 including first portion 26' and second portion 28' is shown. As shown in FIG. 2, second portion 28' is normally a relatively small portion by comparison to first portion 26'. Such is because second portion 28' is primarily a short heat soak section where the temperature of the coal in bed 30 above second portion 28' is stabilized or equalized prior to withdrawing the dried coal product stream from dryer 22. By the improvement of the present invention, the coal leaving dryer 22 is rendered much more homogenous as to individual particle temperatures and has a greatly reduced tendency to include overheated particles in the stream of coal discharged.

Desirably, second portion 28' comprises at least one-tenth of the length across distributor 24. Larger portions of distributor 24 can be used as second portion 28' if necessary.

Having thus described the present invention by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, I claim:

1. In a method for drying particulate low rank coal in a fluidized bed, said method consisting essentially of:

(a) charging said coal to a coal drying zone;

(b) supporting said coal above a support means in said coal drying zone, said support means being adapted to the flow of a hot fluidizing gas upwardly through said support means and said coal;

(c) flowing hot fluidizing gas through said support means and said coal to fluidize said coal and dry said coal; and, (d) retaining said coal in said drying zone for a time sufficient to reduce the water content of said coal to a desired level;

an improvement comprising, fluidizing said coal above a first portion of said support means with a hot fluidizing gas at a temperature from about 400° to about 900° F. to dry said coal and fluidizing said coal above a second portion of said support means with a recycle gas stream, from said coal drying zone and at a temperature below about 200° F. to stabilize the temperature of of said coal, said second portion of said support means being adjacent the coal discharge from said coal drying zone.

2. The improvement of claim 1 wherein a partition is positioned beneath said support means to form a first gas distribution chamber beneath said first portion of said support member and a second gas distribution chamber beneath said second portion of said support member.

3. The improvement of claim 2 wherein said second portion comprises at least one-tenth of the length across said support member from the coal inlet to said coal drying zone to said coal discharge from said coal drying zone.

4. The improvement of claim 1 wherein said fluidizing gas recycled through said second portion of said support means is recycled exhaust gas from said coal drying zone.

5. The improvement of claim 4 wherein said recycle gas is flowed through said coal at substantially the same rate as said hot fluidizing gas.

6. A method for drying particulate low rank coal in a fluidized bed, said method consisting essentially of:

(a) charging said coal to a coal drying zone;

(b) supporting said coal above a support means in said coal drying zone, said support means being adapted to the flow of a hot fluidizing gas upwardly through said support means and said coal;

(c) fluidizing said coal above a first portion of said support means with a hot fluidizing gas, at a temperature from about 400° to about 900° F. to dry said coal;

(d) fluidizing said coal above a second portion of said support means with a recycle gas stream, from said coal drying zone and at a temperature below about 200° F. to stabilize the temperature of said coal, said second portion of said support means being adjacent the coal discharge from said coal drying zone; and, (e) retaining said coal in said drying zone for a time sufficient to reduce the water content of said coal to a desired level.

7. The method of claim 6 wherein a partition is positioned beneath said support means to form a first gas distribution chamber beneath said first portion of said support member and a second gas distribution chamber beneath said second portion of said support member.

8. The method of claim 7 wherein said second portion comprises at least one-tenth of the length across said support member from the coal inlet to said coal drying zone to said coal discharge from said coal drying zone.

9. The method of claim 6 wherein said fluidizing gas recycled through said second portion of said support means is recycled exhaust gas from said coal drying zone.

10. The method of claim 6 wherein said recycle gas is flowed through said coal at substantially the same rate as said hot fluidizing gas.

* * * * *